US008414153B2

(12) United States Patent
Barta

(10) Patent No.: US 8,414,153 B2
(45) Date of Patent: Apr. 9, 2013

(54) HIGH POWERED UNIVERSAL LED LAMP

(75) Inventor: Brett Barta, Hudson, OH (US)

(73) Assignee: Access 2 Communications, Inc., Steubenville, OH (US)

( * ) Notice: Subject to any disclaimer, the term of this patent is extended or adjusted under 35 U.S.C. 154(b) by 67 days.

(21) Appl. No.: 13/204,182

(22) Filed: Aug. 5, 2011

(65) Prior Publication Data

US 2012/0033407 A1 Feb. 9, 2012

Related U.S. Application Data

(60) Provisional application No. 61/370,898, filed on Aug. 5, 2010.

(51) Int. Cl.
*F21V 21/00* (2006.01)

(52) U.S. Cl.
USPC ..... 362/249.02; 362/294; 362/311.02; 362/545; 362/646; 362/650

(58) Field of Classification Search ..... 362/249.02, 362/249.05, 249.06, 294, 311.02, 373, 545, 362/646, 650
See application file for complete search history.

(56) References Cited

U.S. PATENT DOCUMENTS

| | | | | |
|---|---|---|---|---|
| 5,463,280 | A | 10/1995 | Johnson | |
| 5,782,552 | A | 7/1998 | Green et al. | |
| 6,040,663 | A | 3/2000 | Bucks et al. | |
| 6,045,240 | A | 4/2000 | Hochstein | |
| 6,091,614 | A | 7/2000 | Malenfant | |
| 6,577,512 | B2 | 6/2003 | Tripathi et al. | |
| 6,598,996 | B1 | 7/2003 | Lodhie | |
| 6,690,146 | B2 | 2/2004 | Burgyan et al. | |
| 6,786,625 | B2 | 9/2004 | Wesson | |
| 6,984,944 | B2 | 1/2006 | Garrity | |
| 7,262,559 | B2 | 8/2007 | Tripathi et al. | |
| 7,345,433 | B2 | 3/2008 | Bacon et al. | |
| 7,350,936 | B2 | 4/2008 | Ducharme et al. | |
| 7,390,115 | B1 | 6/2008 | Huang et al. | |
| 7,597,456 | B2 | 10/2009 | Catalano et al. | |
| 7,648,257 | B2 | 1/2010 | Villard | |
| 7,661,852 | B2 | 2/2010 | Yu | |
| 7,976,182 | B2 * | 7/2011 | Ribarich | 362/294 |
| 8,297,787 | B2 * | 10/2012 | Yu | 362/249.02 |
| 2008/0122364 | A1 | 5/2008 | McClellan | |
| 2008/0273331 | A1 | 11/2008 | Moss et al. | |
| 2009/0052186 | A1 | 2/2009 | Xue | |

* cited by examiner

*Primary Examiner* — Stephen F Husar
(74) *Attorney, Agent, or Firm* — Brouse McDowell; Heather M. Barnes; Michael G. Craig

(57) ABSTRACT

An LED lamp that allows for the replacement of incandescent bulbs used in various different lighting systems without the degradation of operating properties commonly associated with conventional LED replacement lamps. Regarding a conventional landscape lighting system, the system commonly comprises a transformer configured to supply power to a specific number of individual lamps having a specific bulb installed therein. The LED lamp may allow the user to selectively vary the number of individual lamps utilized in the landscape lighting system. Further, if the landscape lighting system is designed to utilize incandescent bulbs, the LED lamp may allow for the convenient and easy replacement of the incandescent bulbs to allow the user to achieve the maximum benefits associated with the use of LED lamps over conventional incandescent bulbs.

1 Claim, 4 Drawing Sheets

HIGH POWERED UNIVERSAL LED LAMP

This utility application claims priority from a provisional patent application having Ser. No. 61/370,898, filed on Aug. 5, 2010.

I. BACKGROUND

A. Field of Invention

This invention pertains to the art of methods and apparatuses of electronics and lighting and even more particularly, to the art of methods and apparatuses of electronics and lighting that provide illumination utilizing light emitting diodes.

B. Description of the Related Art

The features of the present invention are particularly useful as applied to the construction of LED lamps to replace incandescent lamps used in landscape lighting systems. Conventional landscape lighting systems comprise a transformer electrically coupled to a plurality of individual lamps. Commonly, the lamps are positioned along a portion of landscape to provide light to a specific area. The transformer is supplied 120V AC from a conventional wall outlet or similar source of electric supply. Depending on the specific lighting system utilized, the transformer transforms the 120V AC input into a 12, 15, or 18V AC output that is then provided to the individual lamps.

Although known devices work well for their intended purpose, several disadvantages exist. Commonly, conventional transformers are configured to supply power to a specific number of individual lamps having a specific bulb installed therein. However, depending on the area to be lighted and various individual preferences regarding, for example, aesthetic beauty, functionality, etc., the user may desire to utilize a certain number of individual lamps. In cases where this number differs than the number the transformer is initially configured to be utilized with, the user may encounter various difficulties such as, for example, differences in the amount of light emitted by each lamp and a degradation in the life of the bulbs thereby requiring frequent replacement of the bulbs and increasing the costs associated with utilizing the landscape lighting system. Further, if the landscape lighting system is designed to utilize incandescent bulbs, replacement of the incandescent bulbs with light emitting diode (LED) lamps often fails to allow the user to achieve the maximum benefit of the LED lamp.

II. SUMMARY

One advantage of this invention is that the invention allows for the replacement of incandescent bulbs used in various different lighting systems without the degradation of operating properties commonly associated with conventional LED replacement lamps.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
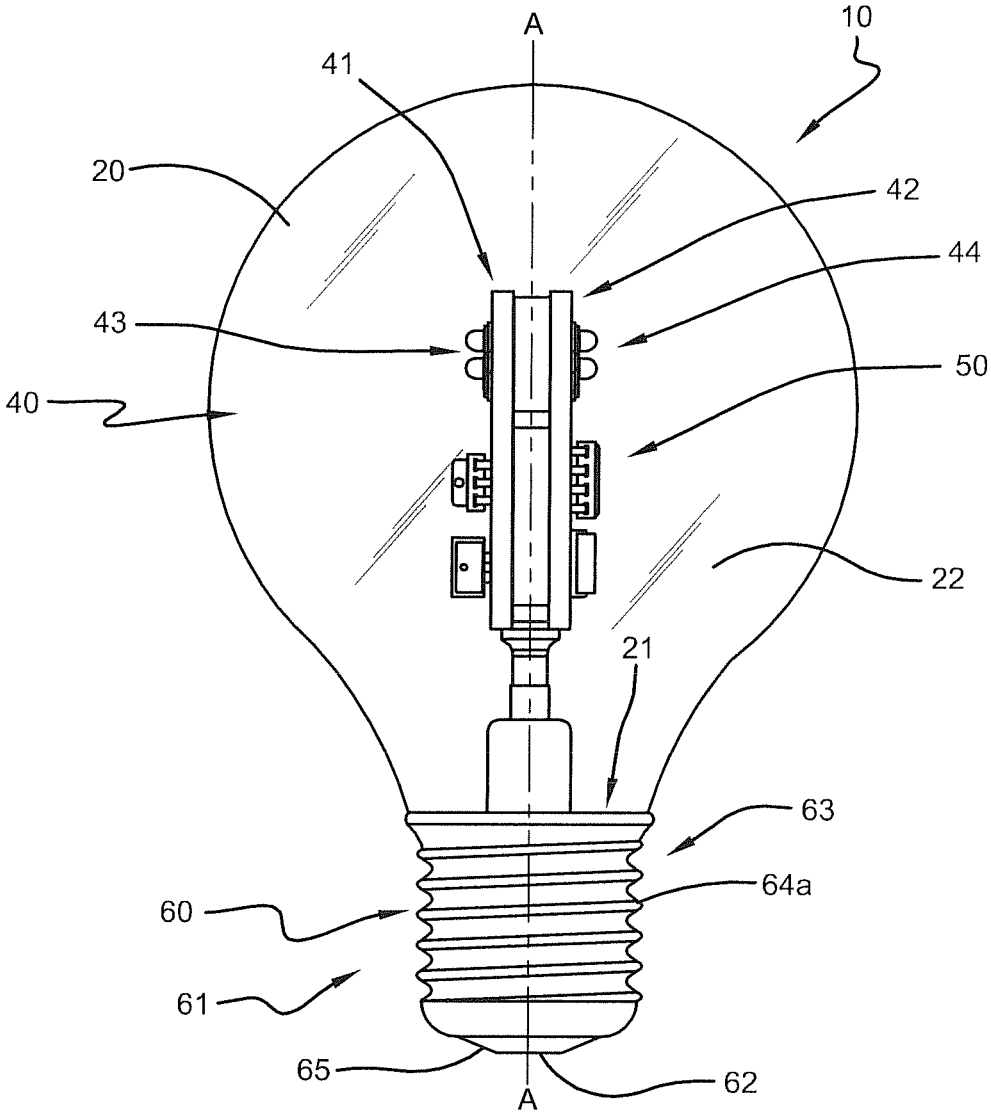
FIG. 1 shows a perspective view of a universal LED lamp according to one embodiment of the invention.
Figure 3:
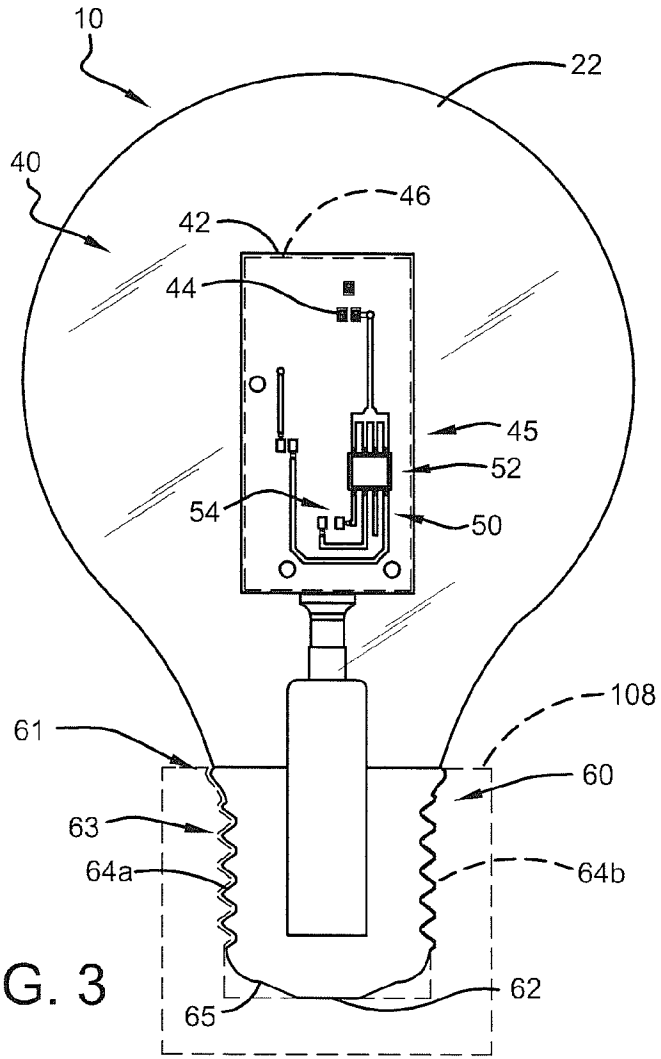
FIG. 3 shows a cut-away rear view along line A-A of a universal LED lamp according to one embodiment of the invention.
Figure 2:
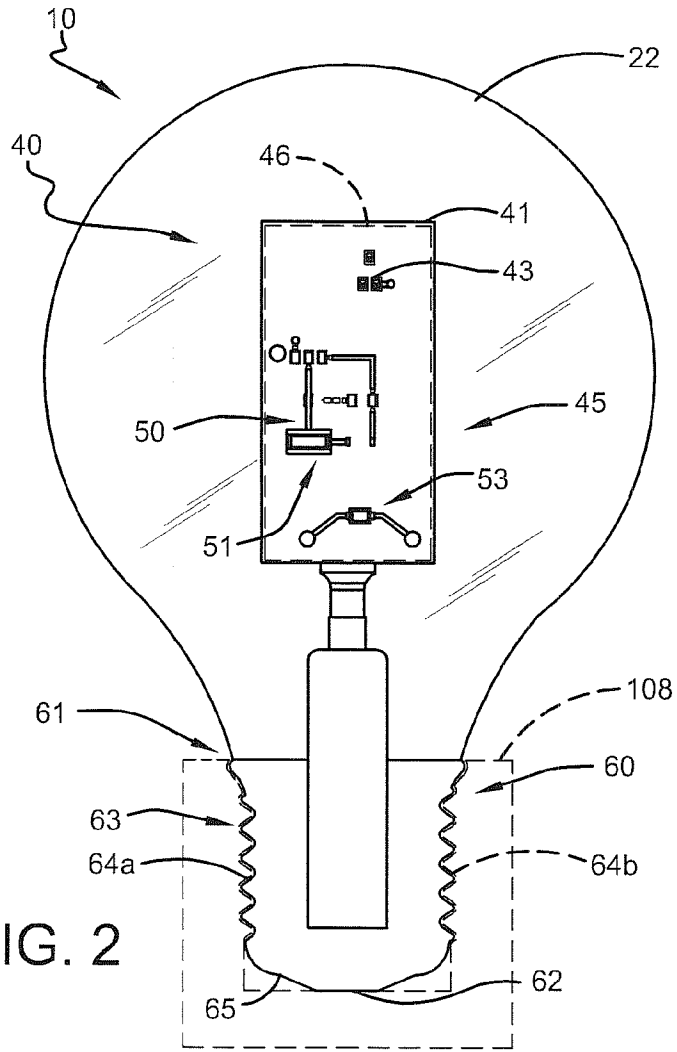
FIG. 2 shows a cut-away front view along line A-A of a universal LED lamp according to one embodiment of the invention.
Figure 4:
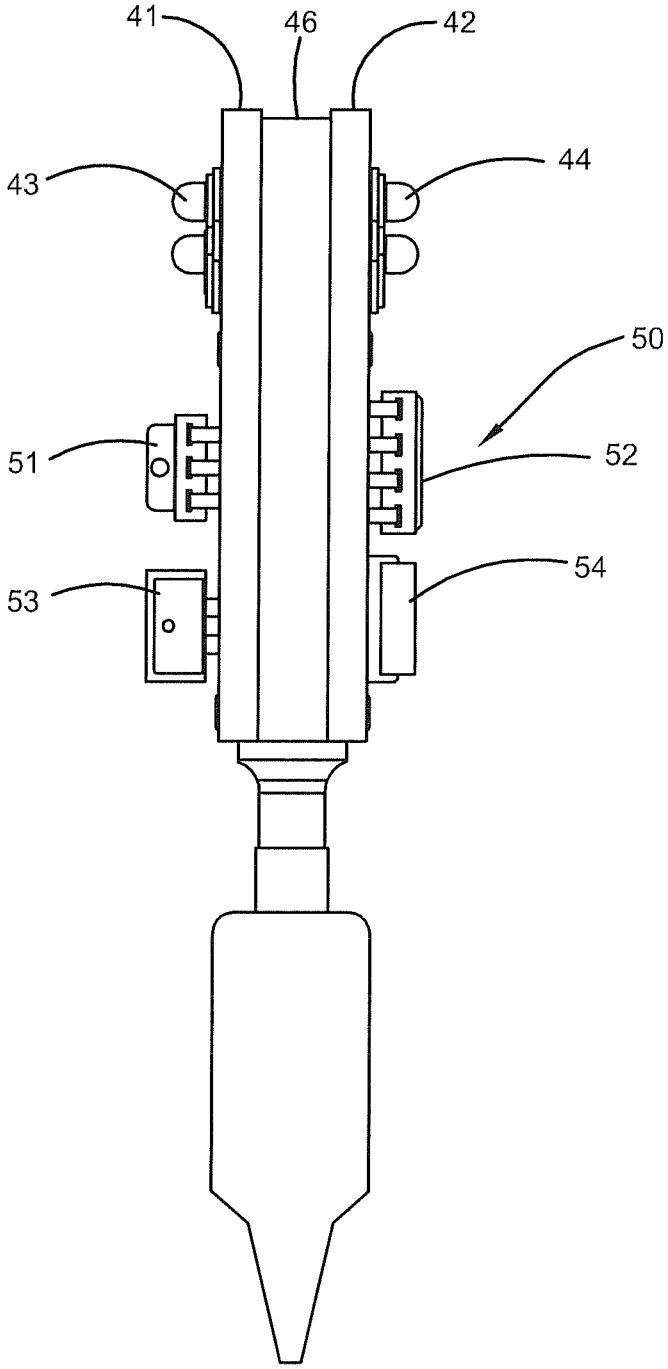
FIG. 4 shows a schematic view of a bulb assembly of a universal LED lamp according to one embodiment of the invention.

Referring now to the drawings wherein the showings are for purposes of illustrating embodiments of the invention only and not for purposes of limiting the same, FIGS. 1-4 show a high powered, universal light emitting diode (LED) lamp 10 according to one embodiment of the invention. The LED lamp 10 may comprise a device suitable to replace incandescent lamps, such as, for example, incandescent lamps utilized in conventional landscape lighting. The LED lamp 10 may allow for the replacement of incandescent bulbs used in various different lighting systems without the degradation of operating properties commonly associated with conventional LED replacement lamps. Commonly, the conventional landscape lighting system comprises a conventional transformer configured to supply power to a specific number of individual lamps having a specific bulb installed therein. The LED lamp 10 may allow the user to selectively vary the number of individual lamps utilized in the landscape lighting system. Further, if the landscape lighting system is designed to utilize incandescent bulbs, the LED lamp 10 may allow for the convenient and easy replacement of the incandescent bulbs to allow the user to achieve the maximum benefits associated with the use of LED lamps over conventional incandescent bulbs. Although the LED lamp 10 is described herein in reference to use with landscape lighting systems, the LED lamp 10 can be utilized in any type of lighting system chosen with sound judgment by a person of ordinary skill in the art.

Figure 5:
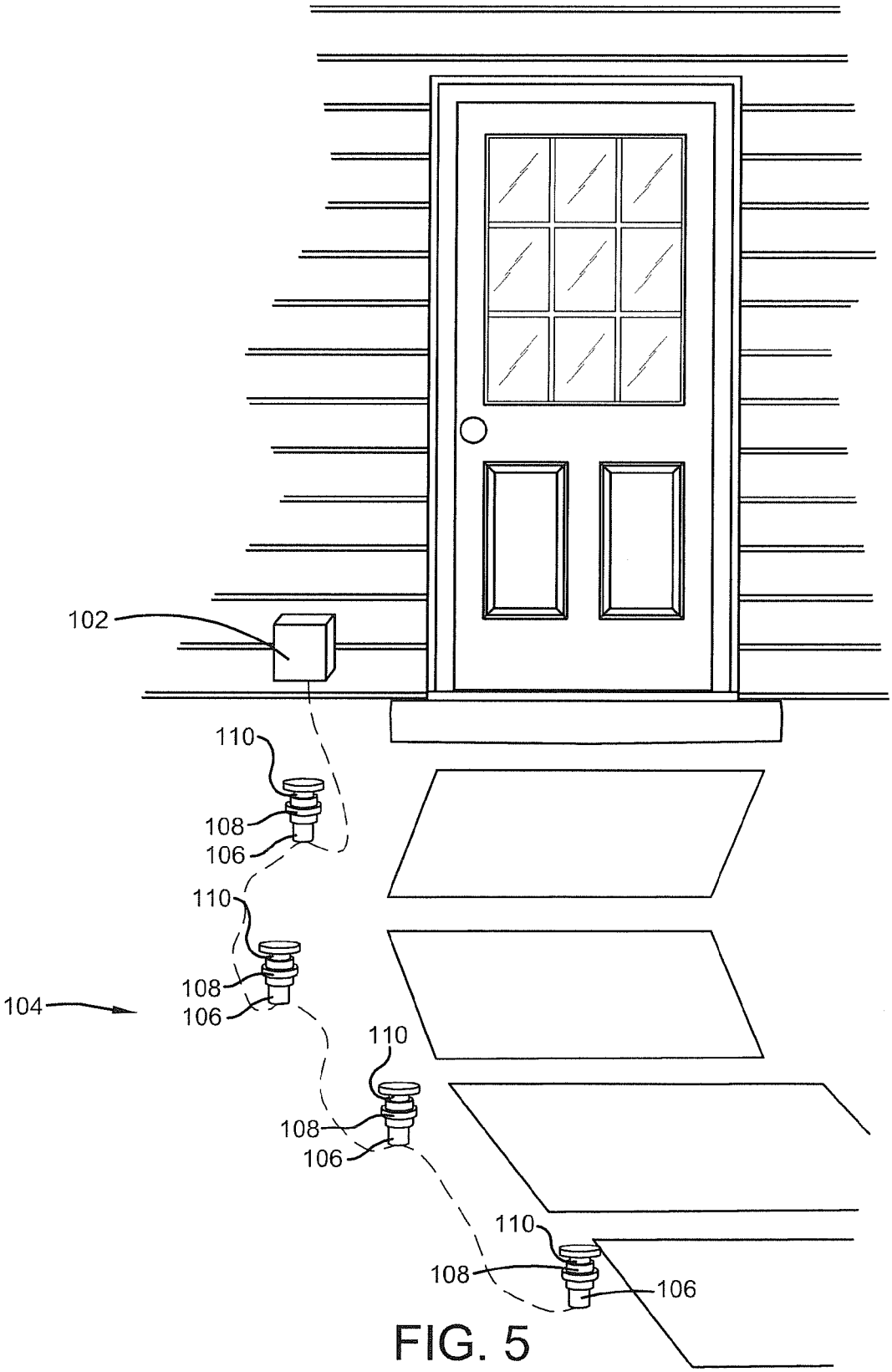
FIG. 5 shows an illustrative view of a landscape lighting system according to one embodiment of the invention.

With reference now to FIGS. 1-5, in one embodiment, the LED lamp 10 may be utilized with an outdoor landscape lighting assembly 100. The landscape lighting assembly 100 may comprise a transformer 102 that converts 120V AC power supplied by an AC household power input, i.e., a conventional wall outlet, to supply electrical energy to a plurality of lighting units 104. In one embodiment, the transformer 102 may cause 10-18V DC electrical energy to be supplied to the plurality of lighting units 104. The transformer 102 may be designed to supply any voltage AC or DC electrical energy chosen with sound judgment of a person of ordinary skill in the art. The plurality of lighting units 104 may be in electrical communication with the transformer 102 in such a manner that allows for the spatial and varied placement of the lighting units 104 to provide a desired amount and configuration of lighting to a selected area of landscape.

With reference now to FIGS. 1-5, each of the plurality of lighting units 104 may comprise may comprise a low voltage light fixture comprising a stake 106, a base assembly 108, and a protective shroud or globe 110. The stake 106 may comprise a device suitable for being inserted into the ground and/or for supporting the components of the lighting unit 104. The base assembly 108 may be fixedly attached to the stake 106 and may comprise a device suitable to receive the LED lamp 10. The base assembly 108 may be in electrical communication with the transformer 102 and may allow electrical energy supplied by the transformer 102 to be selectively supplied to the LED lamp 10 as is well known in the art. In one embodiment, the base assembly 108 may be in electrical communication with the transformer 102 via an electrical conduit, such as, for example, a wire that can be buried beneath the surface of the area desired to be illuminated. The globe 110 may be coupled to the stake 106 and may be positioned adjacent to the base assembly 108. In one embodiment, the globe 110 may be positioned above the base assembly 108 at least partially cover the LED lamp 10 and to diffuse light emitted therefrom.

With reference now to FIGS. 1-4, in one embodiment, LED lamp 10 may comprise a cover 20, a bulb assembly 40, and a socket assembly 60. The cover 20 may comprise a hollow sphere or cube having a lower opening 21 that defines an interior cavity 22. The cover 20 may comprise a transparent or translucent material, such as, for example, a glass or plastic, suitable for allowing the passage of emitted light, as is well known in the art.

With reference now to FIGS. 1-4, in one embodiment, the bulb assembly 40 may comprise a first printed circuit board 41, a second printed circuit board 42, a first LED bulb 43, a second LED bulb 44, a control assembly 45, and a heat sink 46. The first LED bulb 43 may be mounted on the first printed circuit board 41. The second LED bulb 44 may be mounted on the second printed circuit board 42. The first and second printed circuit boards, 41, 42 may be in electrical communication with the control assembly 45 and positioned adjacent to opposing sides of the heat sink 46. The bulb assembly 40 may be in electrical communication with the control assembly 45, as further described below, and may be at least partially encased within the cover 20 such that the first and second LED bulbs 43, 44 are illuminated when electrical power is supplied to the LED lamp 10 and the light produced by the first and second LED bulbs 43, 44 is emitted out through the cover 22.

With reference now to FIGS. 1-4, the control assembly 45 may at least partially control the supply of electrical energy to the first and second LED bulbs 43, 44. In one embodiment, the control assembly 45 may control the supply of electrical energy to the first and second LED bulbs 43, 44 to cause relatively constant voltage and current to be provided to the first and second LED bulbs 43, 44. The control assembly 45 may comprise control circuitry 50 that allows the control assembly 45 to control the electrical energy supplied to the first and second LED bulbs 43, 44 irrespective of the number of LED bulbs and/or lighting units 104 provided to the landscape lighting system 100.

With reference now to FIGS. 1-4, the control circuitry 50 may control the voltage and/or current supplied to the first and second LED bulbs 43, 44 to at least partially ensure that the first and second LED bulbs 43, 44 are provided with a relatively constant voltage and current in order to maintain reliability, prevent degradation, and maintain brightness of the first and second LED bulbs 43, 44. In one embodiment, the control circuitry 50 may comprise a voltage regulator 51, a current limiter 52, a bridge rectifier 53, and a capacitor 54. The voltage regulator 51 and the bridge rectifier 53 may be mounted on the first printed circuit board 41 and the current limiter 52 and the capacitor 54 may be mounted on the second printed circuit board 42. In one embodiment, the voltage regulator 51 may comprise a voltage regulator module that provides a fixed supply voltage to the first and second LED bulbs 43, 44.

With reference now to FIGS. 1-4, the socket assembly 60 may be designed to be received by the base assembly 108 to allow electrical energy to be supplied to the LED lamp 10. In one embodiment, the socket assembly 60 may comprise an electrically conductive base 61 having at least a first electrical contact 62. The base 61 may comprise a substantially conical shape having a lower portion 63. The lower portion 63 may be shaped to be selectively inserted into and/or received by the base assembly 108. In one embodiment, the lower portion 63 may comprise a plurality of threads 64*a* positioned about its outer circumference that can engage corresponding threads 64*b* positioned within a recessed portion 109 of the base assembly 108. The electrical contact 62 may be in electrical communication with the control circuitry 50 and may at least partially protrude from a bottom surface 65 of the lower portion 63. The electrical contact 62 may be designed to contact the base assembly 108 such that the control circuitry 50 is brought into electrical communication with the transformer 102 so as to allow the control circuitry 50 to control the supply of electrical energy to the first and second LED bulbs 43, 44.

With reference now to FIGS. 1-4, a method for lighting a desired area using the landscape lighting system 100 including the LED lamp 10 is described. In one embodiment, the plurality of lighting units 104 may be selectively positioned to illuminate a first area 120. An electrical conduit 101*a* may extend between adjacent lighting units 104 and between an end lighting unit 104*a* and the transformer 102. The transformer 102 may be placed in electrical communication with a source of electrical energy 1, such as, for example, a conventional wall outlet, via a second electrical conduit 101*b*. The source of electrical energy 1 may supply electrical energy to the transformer 102. The transformer 102 may transform the electrical energy supplied by the source of electrical energy to comprise a first predetermined voltage 2 and a first predetermined current 3. The first predetermined voltage 2 and the first predetermined current 3 may comprise a voltage and current designed to allow the landscape lighting system 100 to operate wherein the landscape lighting system 100 comprises a predetermined number of lighting units 104.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A LED bulb comprising:

a first printed circuit board having a first top surface and a first bottom surface;

a second printed circuit board having a second top surface and a second bottom surface;

a first light emitting diode mounted to the first top surface of the first printed circuit board, wherein the first light emitting diode is electrically coupled to the first printed circuit board;

a second light emitting diode mounted to the second top surface of the second printed circuit board, wherein the second light emitting diode is electrically coupled to the first printed circuit board;

a heat sink positioned between the first bottom surface of the first printed circuit board and the second bottom surface of the second printed circuit board;

a bridge rectifier electrically coupled to the first printed circuit board;

a voltage regulator electrically coupled to the first printed circuit board;

a capacitor electrically coupled to the second printed circuit board;

a current limiter electrically coupled to the second printed circuit board;

a socket electrically coupled to the first printed circuit board;

a housing, wherein the housing substantially encloses the first and second light emitting diodes, the housing comprising a composition suitable to allow the penetration of light emitted by the first and second light emitting diodes to pass therethrough.

* * * * *